US006578951B2

(12) United States Patent
Ozaki et al.

(10) Patent No.: US 6,578,951 B2
(45) **Date of Patent: *Jun. 17, 2003**

(54) SUBSTRATE FOR USE OF AN INK JET RECORDING HEAD, A METHOD FOR MANUFACTURING SUCH SUBSTRATE, AN INK JET RECORDING HEAD, AND AN INK JET RECORDING APPARATUS

(75) Inventors: Teruo Ozaki, Yokohama (JP); Ichiro Saito, Yokohama (JP); Yoshiyuki Imanaka, Kawasaki (JP); Toshimori Miyakoshi, Yokohama (JP); Muga Mochizuki, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/210,550

(22) Filed: Dec. 14, 1998

(65) Prior Publication Data

US 2003/0052946 A1 Mar. 20, 2003

(30) Foreign Application Priority Data

Dec. 18, 1997 (JP) ..... 9-349334

(51) Int. Cl.[7] ..... B41J 2/05
(52) U.S. Cl. ..... 347/58; 257/381; 438/21
(58) Field of Search ..... 347/58, 59, 62, 347/63, 56; 257/379, 380, 381, 385; 438/21; 29/890.1

(56) References Cited

U.S. PATENT DOCUMENTS

| | | | | |
|---|---|---|---|---|
| 4,532,530 A | * | 7/1985 | Hawkins | 347/62 |
| 4,723,129 A | | 2/1988 | Endo et al. | 347/56 |
| 4,740,796 A | | 4/1988 | Endo et al. | 347/56 |
| 5,169,806 A | | 12/1992 | Hawkins et al. | 437/233 |
| 5,352,923 A | * | 10/1994 | Boyd et al. | 257/536 |
| 5,474,948 A | * | 12/1995 | Yamazaki | 437/60 |
| 5,479,197 A | | 12/1995 | Fujikawa et al. | 347/63 |
| 5,580,468 A | | 12/1996 | Fujikawa et al. | 216/27 |
| 5,980,025 A | * | 11/1999 | Burke et al. | 347/62 |

FOREIGN PATENT DOCUMENTS

| | | | |
|---|---|---|---|
| EP | 0 493 897 | | 7/1992 |
| EP | 0 494 076 | | 7/1992 |
| EP | 0 596 705 | | 5/1994 |
| EP | 674 995 | * | 4/1995 |
| EP | 0 674 995 | | 10/1995 |
| JP | 2-34786 | | 2/1990 |
| JP | 7-89073 | | 4/1995 |
| JP | 7-125218 | | 5/1995 |
| JP | 08-118 636 | | 5/1996 |

* cited by examiner

*Primary Examiner*—John Barlow
*Assistant Examiner*—Blaise Mouttet
(74) *Attorney, Agent, or Firm*—Fitzpatrick, Cella, Harper & Scinto

(57) ABSTRACT

A substrate for use in an ink jet recording head includes a plurality of heat generating resistive members formed on the substrate, a wiring pattern formed to be electrically connected with the heat generating resistive members, and a protection film formed on the heat generating resistive members and the wiring pattern to protect them from ink, and then, a vertically turn-up wiring structure is formed with an insulation film formed on the substrate, and one side of the wiring connected with the heat generating resistive members is arranged immediately below the heat generating resistive members in a width and a length larger than that of heat generating resistive members with the insulation film between them. For this substrate, the heat generating resistive members and the wiring positioned immediately below them are formed by polysilicon having impurities in different densities. With the structure thus arranged, it becomes possible to form the vertically turn-up wiring structure for heat generating resistive members arranged at pitches in high density using polysilicon.

7 Claims, 8 Drawing Sheets

114
111
110
106
105
104
103
102
107
108

SUBSTRATE FOR USE OF AN INK JET RECORDING HEAD, A METHOD FOR MANUFACTURING SUCH SUBSTRATE, AN INK JET RECORDING HEAD, AND AN INK JET RECORDING APPARATUS

BACKGROUND OF THE INVENTION

1. Field of the Invention

The present invention relates to a substrate for use of an ink jet recording head, a method for manufacturing such substrate, an ink jet recording head, and an ink jet recording apparatus.

2. Related Background Art

The ink jet recording method which is disclosed in the specification of U.S. Pat. No. 4,723,129 or 4,740,796 makes it possible to perform a highly precise recording in high quality and density at higher speeds. With this method, it is easier to record in colors by use of a compact recording apparatus. Particularly, in recent years, this method has attracted much attention. For the typical example of an apparatus that uses this method, it is arranged to utilize thermal energy for discharging recording liquid or the like (hereinafter referred to as ink). The apparatus is provided with a thermal activation portion to enable heat to act upon ink. In other words, for each of the ink flow paths, there are arranged a pair of wiring electrodes and an electrothermal converting member connected with the wiring electrodes. This member is formed by the heat generating resistive layer to generate heat in an area between the wiring electrodes and heat ink abruptly to foam on the thermal activation portion by the utilization of the thermal energy generated by the heat generating resistive layer, and discharge ink by means of the foaming thus created.

Now, in this respect, many proposals have been made as to the materials and structure of the heat generating resistive layer of the ink jet recording head. For example, the one disclosed in the specification of Japanese Patent Laid-Open Application No. 7-125218 is a heat generating resistive member of Ta type or the one disclosed-in the specification of U.S. Pat. No. 5,169,806 is a heat generating resistive member that uses polysilicon. Also, in order to arrange the pitches of the heat generating resistive members in higher density, it has been proposed to arrange the wiring below heat generating resistive members so as to eliminate the wiring between each of the heat generating resistive members as disclosed in the specification of Japanese Patent Publication No. 2034786, for example.

However, for the conventional structure that uses polysilicon heat generating resistive members, there is a problem encountered that if it is attempted to use the wiring pattern immediately below the heat generating resistive members in order to arrange them in higher density, the conventional structure cannot be adopted practically from the manufacturing point of view.

In other words, the wiring which is usually used is Al or Al alloy in general, and the fusion point thereof is approximately 580° C. Here, on the other hand, the polysilicon formation temperature is beyond 600° C. as practicably adopted for the general semiconductor process. If this high temperature process is required subsequent to having formed Al wiring, the Al is diffused eventually.

Because of a problem of the kind, the Al or Al alloy wiring cannot be arranged below the layer using polysilicon as the heat generating resistive members.

SUMMARY OF THE INVENTION

The present invention is designed with a view to solving the problems discussed above. It is an object of the invention to provide the vertically turn-up wiring structure capable of arranging heat generating resistive members in higher density, while using polysilicon for the heat generating resistive members.

It is another object of the invention to provide a method of manufacture which makes it possible to arrange the connection with metallic wiring for use of current supply for the vertically turn-up wiring structure of the heat generating resistive members using polysilicon.

Here, with the provision of means given below, it is possible to achieve these objectives.

In other words, the substrate for use in an ink jet recording head, which is proposed herein by the present invention, comprises a plurality of heat generating resistive members formed on the substrate; a wiring pattern formed to be electrically connected with the heat generating resistive members; and a protection film formed on the heat generating resistive members and the wiring pattern to protect them from ink, and then, a vertically turn-up wiring structure is formed with an insulation film formed on the substrate, and one side of the wiring connected with the heat generating resistive members is arranged immediately below the heat generating resistive members in a width and a length larger than that of heat generating resistive members with the insulation film between them. For this substrate, the heat generating resistive members and the wiring positioned immediately below them are formed by polysilicon having impurities in different densities. Here, each sheet resistance of the heat generating resistive members is 70 to 300 Ω/□, and the polysilicon sheet resistance of the wiring positioned immediately below them is 1 to 20 Ω/□. Also, the vertically turn-up portion of a plurality of vertically turn-up wiring structures using polysilicon for the heat generating resistive members and the lower layer wiring with the insulation film between them is arranged to form a step higher than the substrate portions positioned on both sides thereof. Further, each thickness of the heat generating resistive members and the wiring positioned immediately below them is 50 to 1,000 nm.

Also, a method, which is proposed herein by the present invention for manufacturing a substrate for use of an ink jet recording head, which is provided with a plurality of heat generating resistive members formed on the substrate; a wiring pattern formed to be electrically connected with the heat generating resistive members; and a protection film formed on the heat generating resistive members and the wiring pattern to protect them from ink, and a vertically turn-up wiring structure being formed with an insulation film formed on the substrate, and one side of wiring connected with the heat generating resistive members being arranged immediately below the heat generating resistive members with the insulation film between them, comprises the step of forming metallic wiring connected with the portion having the heat generating resistive members and the wiring positioned immediately below them subsequent to the formation of the portion. Then, the metallic wiring used for this method is Al or Cu individually or an allow thereof.

Further, the objectives of the present invention are achieved with the provision of an ink jet recording head comprising the substrate described in the preceding paragraphs, and the ink flow paths arranged corresponding to the heat generating resistive members, as well as with the provision of an ink jet recording apparatus which comprises such ink jet recording head for performing recording by discharging ink from the discharge ports thereof in accordance with recording signals.

DETAILED DESCRIPTION OF THE PREFERRED EMBODIMENTS

Hereinafter, the present invention will be described more specifically in accordance with the embodiments thereof.

First Embodiment

Now, hereunder, with reference to the accompanying drawings, the detailed description will be made of the present invention.

Figure 1:
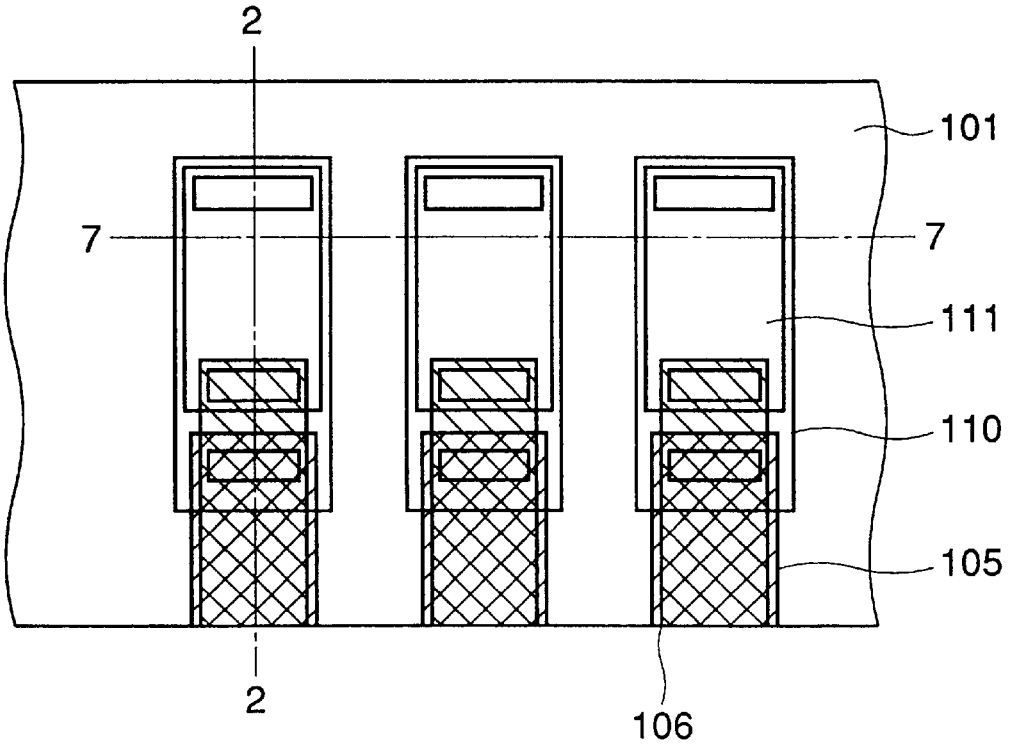
FIG. 1 is a plan view which shows an ink jet substrate in accordance with a first embodiment of the present invention.
Figure 2:
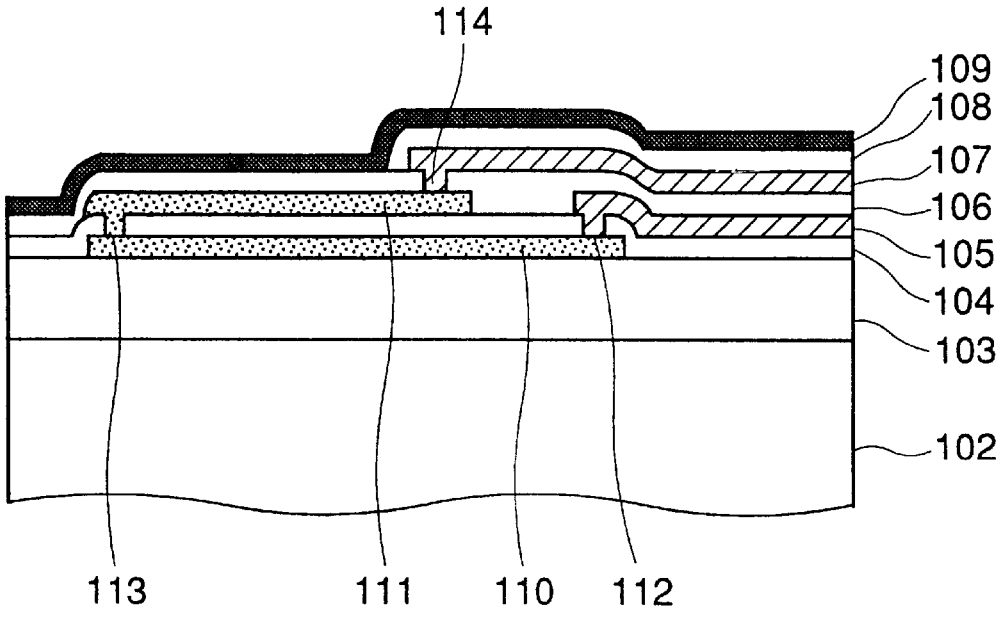
FIG. 2 is a cross-sectional view which shows the substrate, taken along line 2—2 in FIG. 1.
Figure 3:
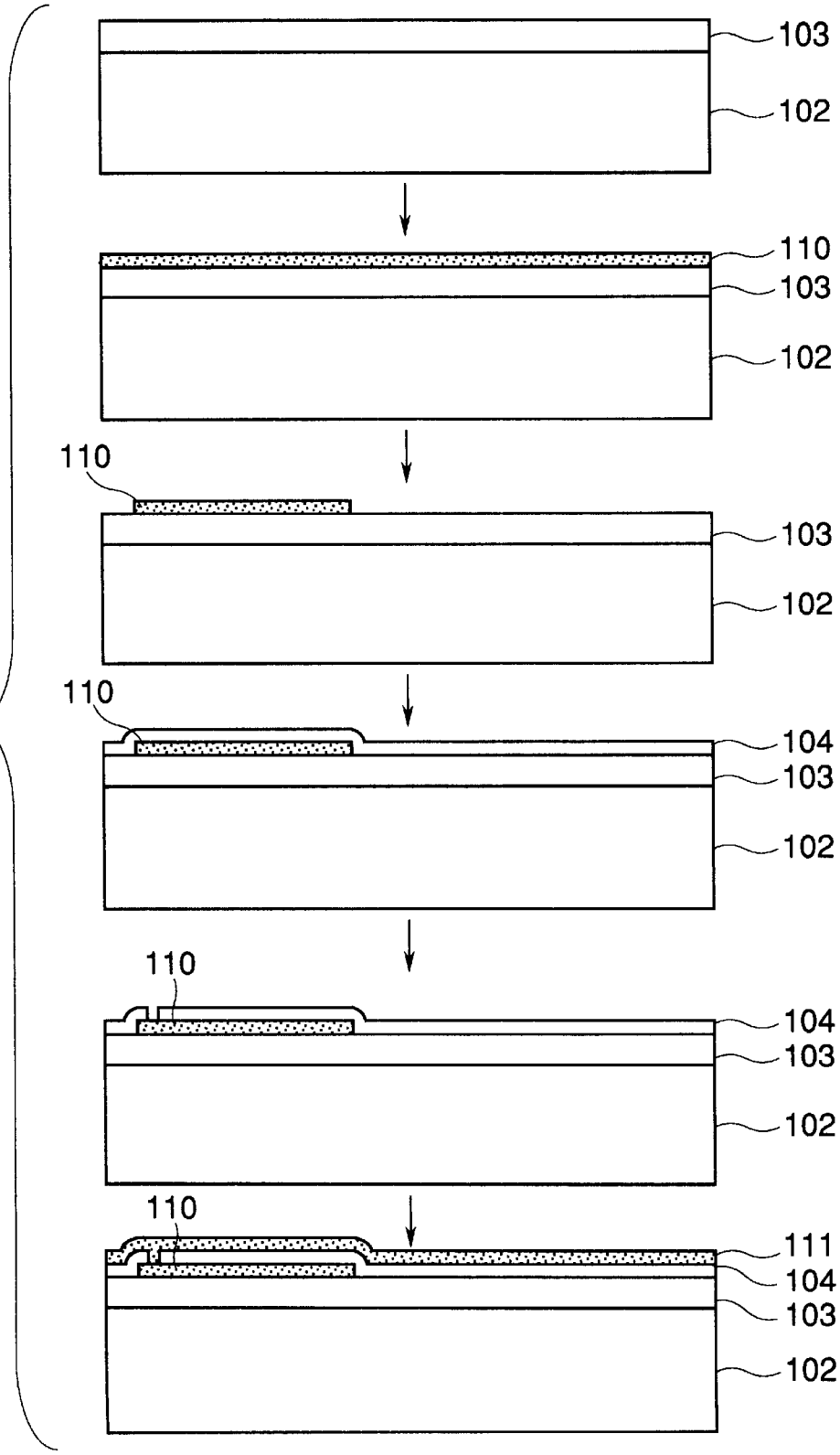
FIG. 3 is a manufacture flow of the ink jet substrate in accordance with the first embodiment of the present invention.
Figure 4:
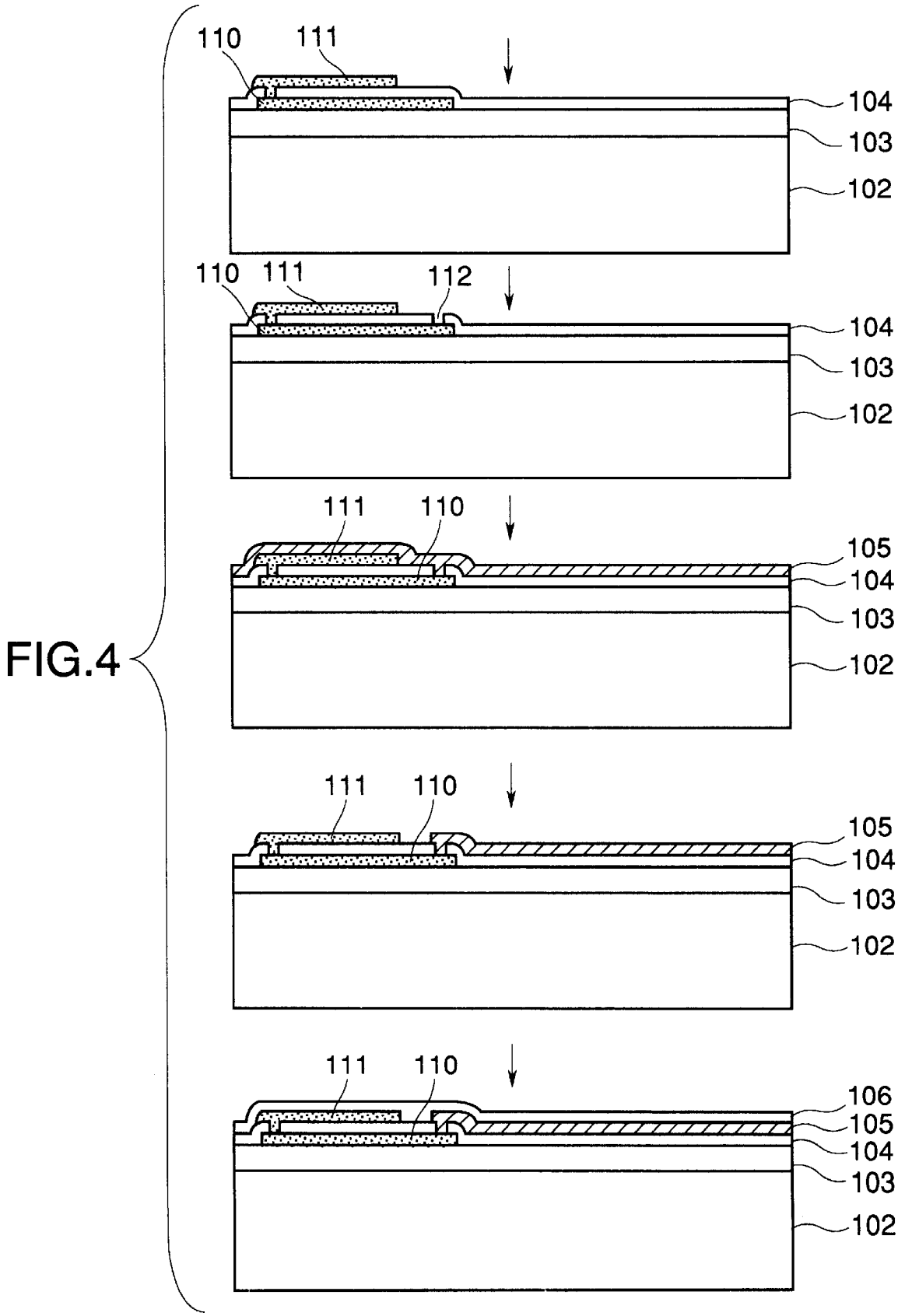
FIG. 4 is a manufacture flow of the ink jet substrate in accordance with the first embodiment of the present invention.
Figure 5:
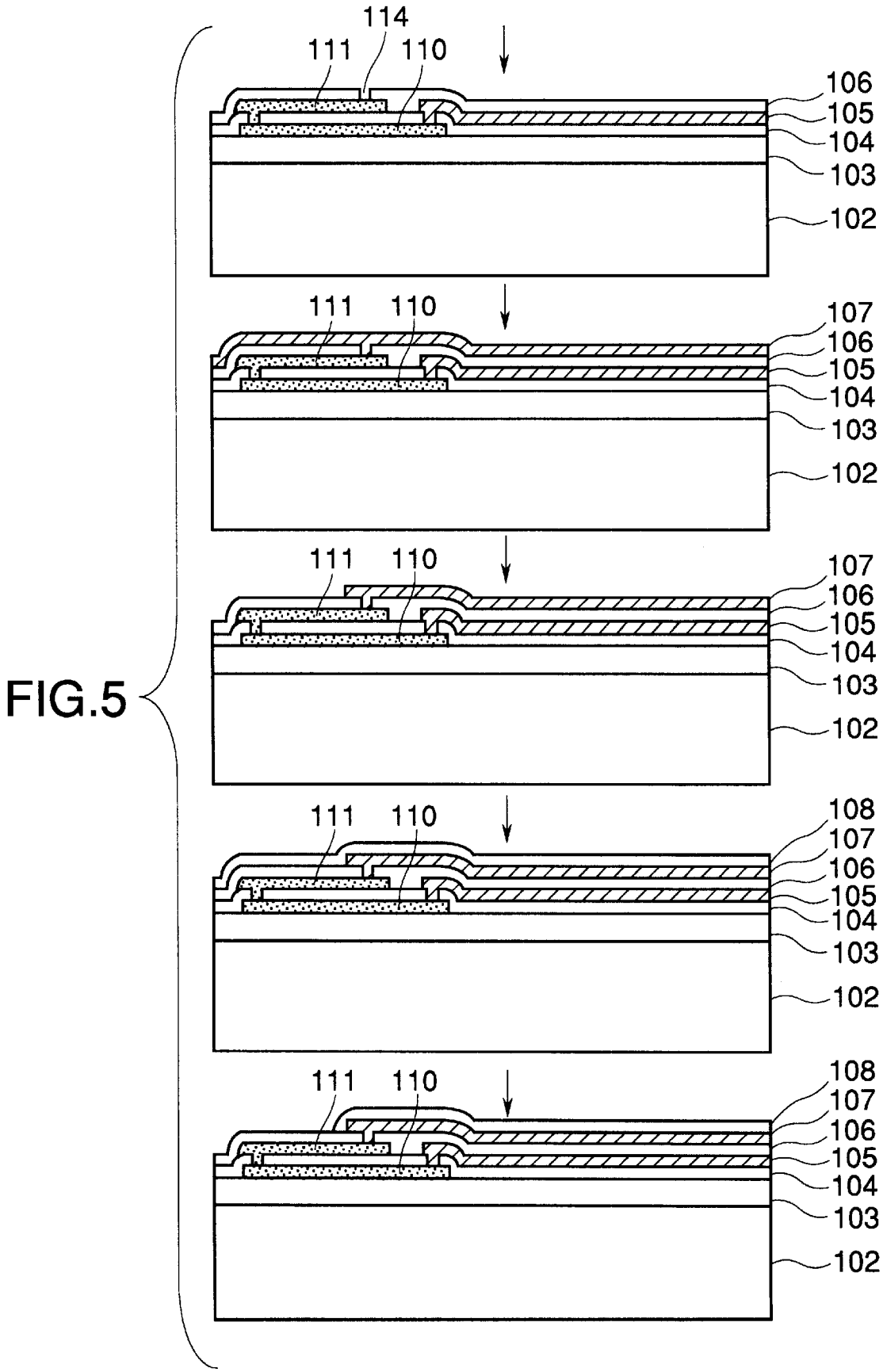
FIG. 5 is a manufacture flow of the ink jet substrate in accordance with the first embodiment of the present invention.
Figure 6:
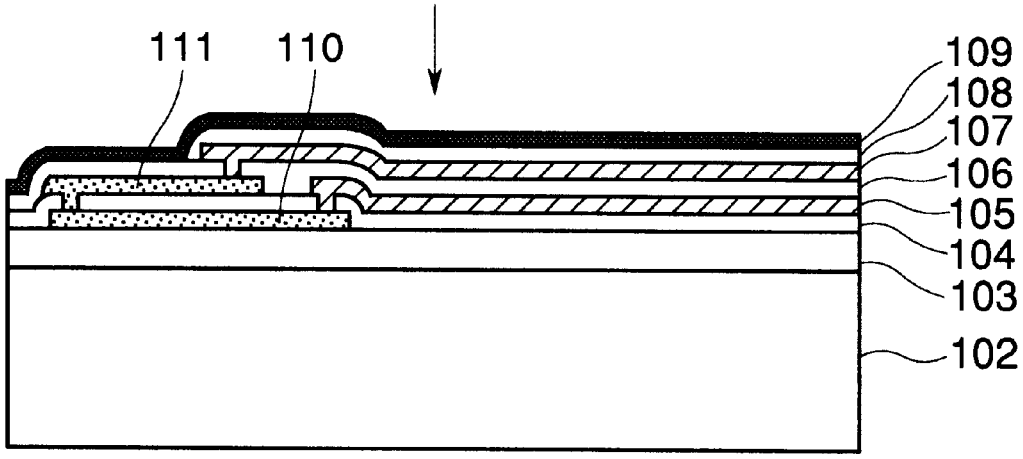
FIG. 6 is a manufacture flow of the ink jet substrate in accordance with the first embodiment of the present invention.

FIG. 1 is a plan view which shows the heat generating unit substrate 101 of an ink jet recording head on which ink is caused to foam in accordance with a first embodiment of the present invention. FIG. 2 is a partial view of the section of the substrate represented in FIG. 1, taken along the one dot chain line 2—2 which cuts the surface of the substrate vertically in FIG. 1.

In accordance with the present embodiment, the Si substrate 102 (or the Si substrate having driving ICs already incorporated thereon) or the like is used for the formation of the heat generating unit substrate. On the substrate, the $SiO_2$ film 103 is formed in advance for use of heat accumulation.

Then, polysilicon 110 is formed on the entire surface of the substrate with polysilicon being developed by the application of CVD method at approximately 620° C.

Subsequently, patterning is performed in the photolithographical process, and by the application of reactive ion etching, the polysilicon is etched into a specific configuration. Here, the polysilicon thus etched becomes the gate material of the IC driving portion, and also, becomes the wiring of the vertically turn-up wiring below the heat generating resistive members in the heat generating resistive portion. Then, the width and length of the polysilicon is made larger than the heat generating resistive portion which is formed in the later process, thus eliminating any steps in the ink foaming portion above the heat generating element for the enhancement of its reliability. After that, by means of phosphoric ion implantation or phosphoric diffusion, the polysilicon is processed to provide a specific sheet resistance value. Here, the phosphoric density should be controlled so that the sheet resistance of polysilicon may become 1 Ω/□ to 20 Ω/□ for the polysilicon that becomes wiring immediately below the heat generating resistive members. After that, PSG (SiO film that contains phosphorus) 104 is developed in a thickness of approximately 800 nm by means of the CVD development at approximately 400° C. This film becomes the insulation film against the upper layer polysilicon which is formed later.

Then, patterning is performed in the photolithographical process, and drilling is made by the application of reactive ion etching to form a specific configuration as at 113 (here, through hole portion).

Subsequently, the polysilicon 111 is formed on the entire surface at 620° C. After that, by means of phosphoric diffusion or ion implantation, phosphorus is added to and diffused in the polysilicon so that its sheet resistance becomes 70 Ω/□ to 300 Ω/□.

Then, in the photolithographical process, patterning is performed and by means of reactive ion etching, the polysilicon is etched to be in a specific configuration (here, the configuration of the heat generating resistive members).

Then, further in the photolithographical process, basic insulation layer is patterned to form the contact hole 112.

Then, the first layer Al 105 is formed by the application of sputtering in a thickness of approximately 500 nm, and patterning is performed in the photolithographical process. After that, this layer is etched by means of reactive ion etching to be in a specific configuration (here, in the configuration of wiring).

Then, the SiN 106 is formed by the application of CVD development in a thickness of approximately 1,000 nm at approximately 400° C.

Then, in the photolithographical process, patterning is performed, and by means of reactive ion etching, the through hole 114 is formed.

After that, the second layer Al 107 is formed by the application of sputtering in a thickness of approximately 500 nm. Then, in the photolithographical process, patterning is performed, and by means of reactive ion etching, this layer is etched to be in a specific configuration (here, the configuration of wiring).

Then, by the application of CVD development, the SiN 108 is formed in a thickness of approximately 1,000 nm at approximately 400° C. In continuation, as the cavitation proof film, Ta 109 is formed in a thickness of 230 nm. Subsequently, in the photolithographical process, patterning is performed, and by means of reactive ion etching, the Ta and SiN are etched to complete the substrate.

So far, the description has been made of the vertically turn-up wiring structure of polysilicon having different impurities in it as the first object of the present invention, and the manufacture method for connecting the metal wiring in the structure using polysilicon as the second object of the invention. FIG. 3, FIG. 4, FIG. 5, and FIG. 6 are views which illustrate the flow of manufacture therefor.

Second Embodiment

With the vertically turn-up wiring using polysilicon as wiring on the lower layer and heat generating resistive members with the insulation film between them, it becomes possible to obtain the effect as given below if the thickness of two polysilicon layers is made larger.

For example, the following proposal has been made in the specification of Japanese Patent Laid-Open Application No. 7-89073.

Although strict precision is required when the ceiling plate, which has grooves that become ink flow paths, is bonded with the ink jet substrate, it is possible to simplify the manufacture process by cutting grooves on the ink jet substrate in advance, and then, the wall portions of the grooved ceiling plate 116 are fitted into the grooves thus cut on the substrate to assemble them. In order to attain this proposed process, an extra step is required for cutting the grooves when the ink jet substrate is manufactured. In practice, however, it is only possible to cut the grooves in the depth of approximately 1,000 nm.

Figure 7:
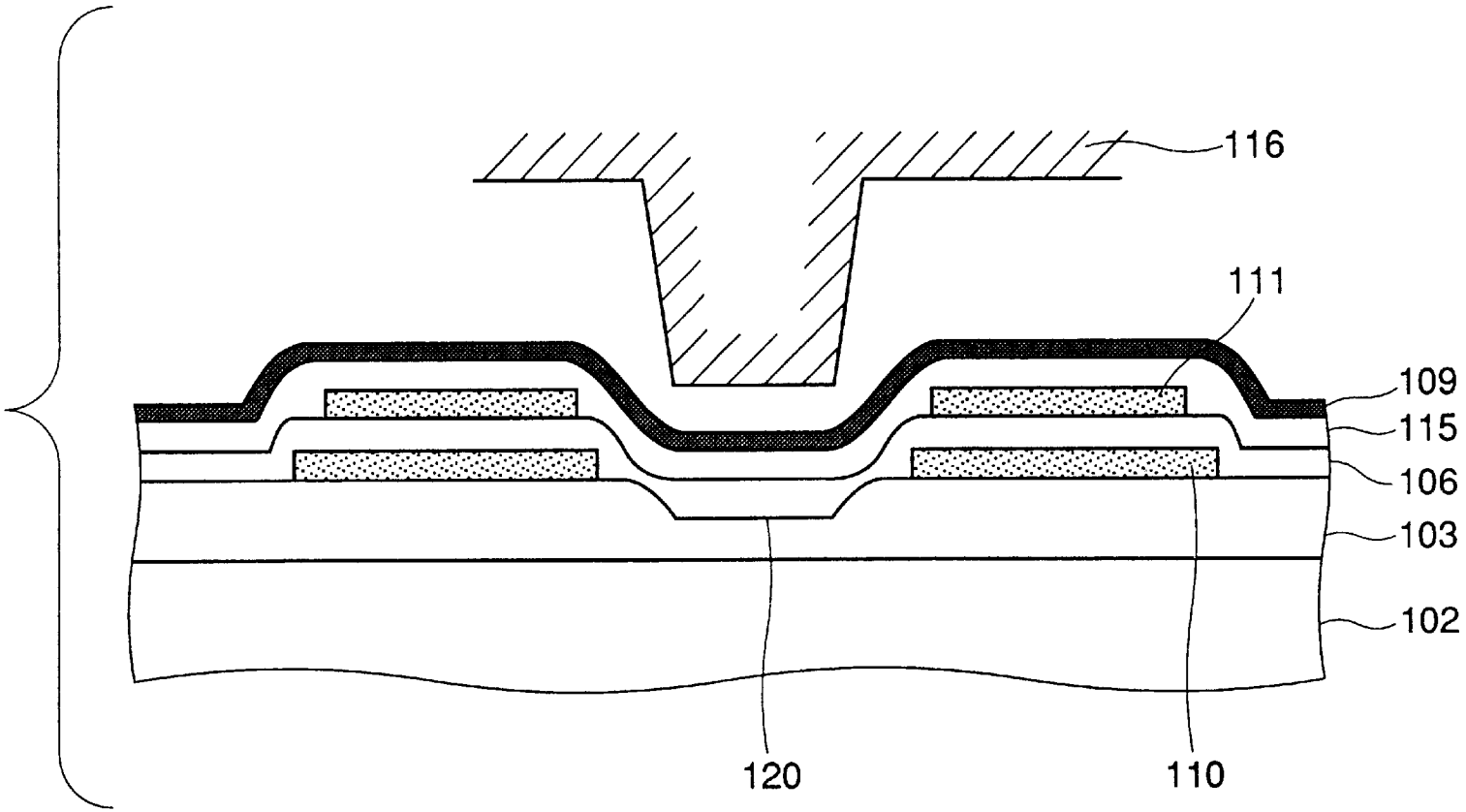
FIG. 7 is a cross-sectional view which shows an ink jet substrate in accordance with a second embodiment of the present invention, taken along line 7–7 in FIG. 1.

In this respect, if the thickness of polysilicon of the heat generating resistive members and the wiring positioned immediately below them should be made 500 nm to 1,000 nm each, it becomes possible to provide a step of 1,000 to 2,000 nm. FIG. 7 is a cross-sectional view which shows a structure of the kind.

Other Embodiments

Now, hereunder, the description will be made of an ink jet recording head and an ink jet recording apparatus for which the present invention is adopted.

Figure 8:
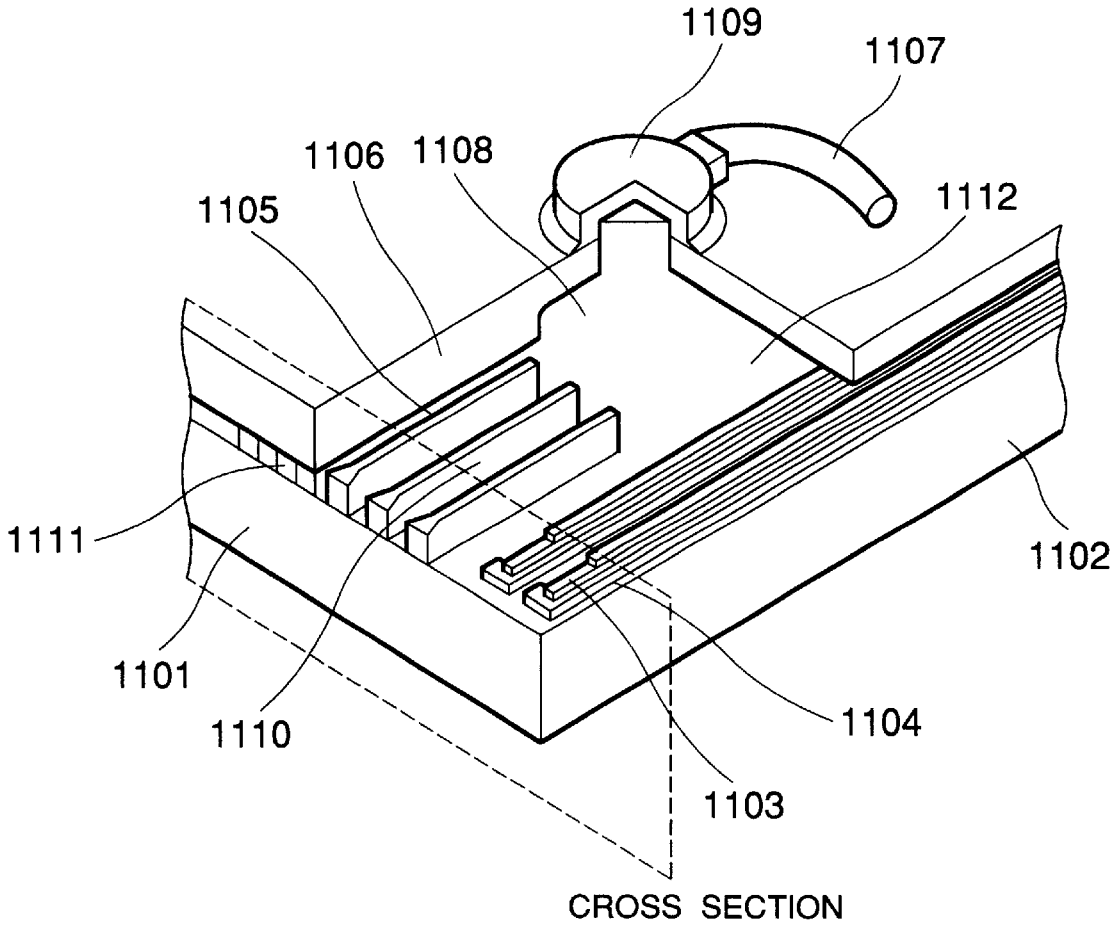
FIG. 8 is a view which schematically shows the structure of an ink jet recording head to which the present invention is applicable.

FIG. 8 is a structural view which schematically shows such ink jet recording head. In FIG. 8, the ink jet recording head comprises electrothermal converting members 1103, wiring 1104, liquid path walls 1105, and ceiling plate 1106, which are arranged on the substrate 1102 by means of film formation through etching, vapor deposition, sputtering, or some other semiconductor manufacture process. Recording liquid 1112 is supplied from a liquid retaining chamber (not shown) to the common liquid chamber 1108 of the recording head 1101 through the liquid supply tube 1107. In FIG. 8, a reference numeral 1109 designates the connector for use of the liquid supply tube. Liquid 1112 supplied to the common liquid chamber 1108 is supplied to the liquid paths 1110 by means of the so-called capillary phenomenon, and held stably with the menisci which are formed at the discharge port surface (orifice surface) arranged at the leading end of each of the liquid paths. Here, when each of the electrothermal converting members 1103 is energized, liquid on each surface of electrothermal converting members is heated abruptly to create such bubble in each liquid path. Then, by the expansion and contraction of each bubble, liquid is discharged from each of the discharge ports 1111 to form droplets, respectively.

Figure 9:
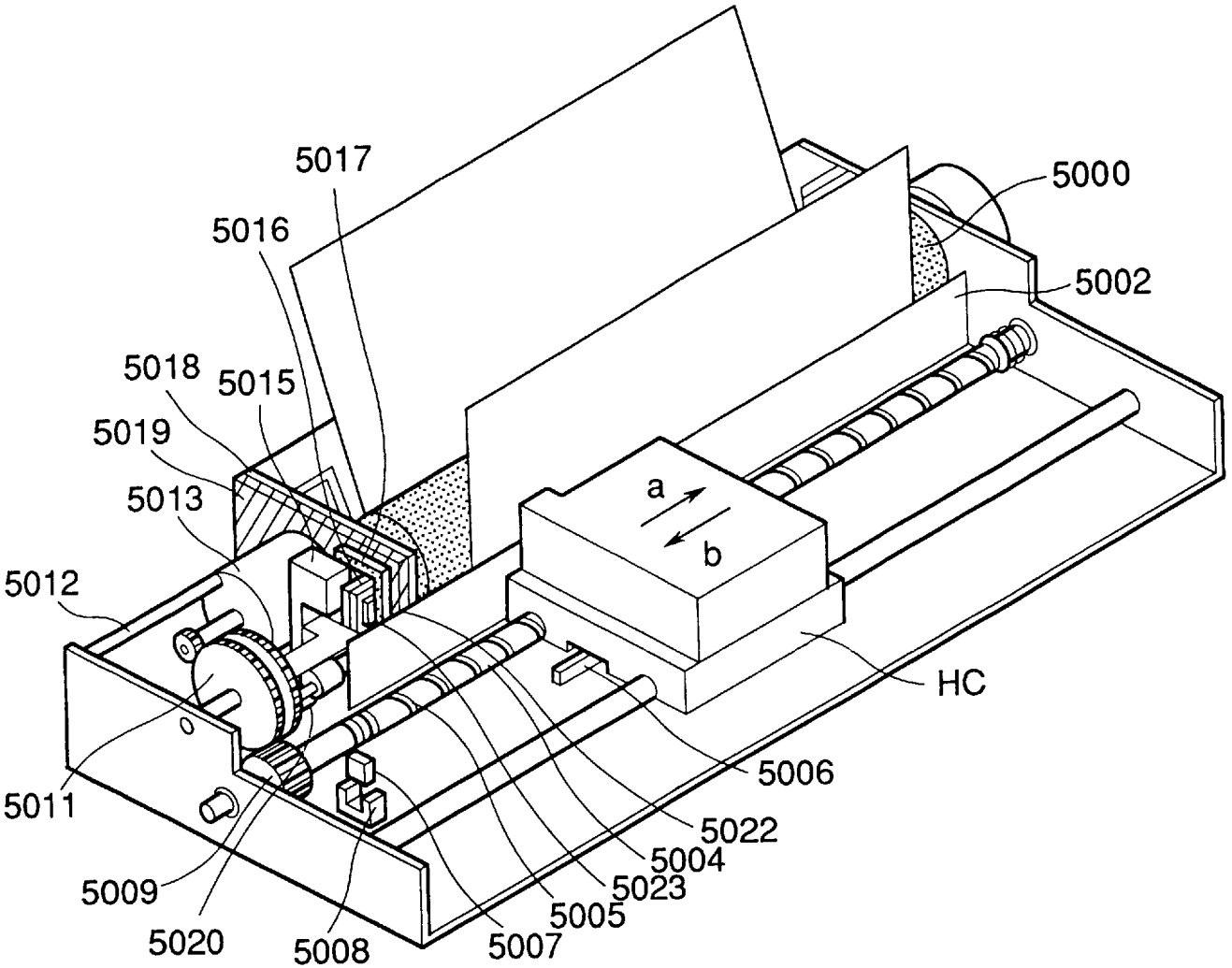
FIG. 9 is a perspective view which schematically shows an ink jet recording apparatus to which the present invention is applicable.

FIG. 9 is a perspective view which schematically shows an ink jet recording apparatus to which the present invention is applicable. In FIG. 9, the ink jet recording apparatus is provided with a carriage HC having a pin (not shown) whereby to engage with the spiral groove 5004 of the lead screw which is interlocked with the regular and reverse rotations of the driving motor 5013 to rotate through the driving power transmission gears 5011 and 5009. The carriage reciprocates in the directions indicated by arrows a and b. A reference numeral 5002 designates a paper sheet pressure plate to press the paper sheet to the platen 5000 over the traveling direction of the carriage. Reference numerals 5007 and 5008 designate the photo-couplers which serve as home position detecting sensor in order to confirm the presence of the lever 5006 of the carriage in this region, and switch the rotational directions of the motor 5013, among some other operations; 5016, the member that supports the capping member 5022 which caps the front end of the recording head; 5015, suction means that sucks the interior of the cap to perform the suction recovery of the recording head through the aperture 5023 in the cap; 5017, a cleaning blade; 5019, the member that enables the blade to move forward and backward; and 5018, the main body supporting plate which support these members. Here, the blade is not necessarily limited to the configuration described above. It is of course possible to adopt any type of known cleaning blade for the present embodiment. Also, a reference numeral 5012 designates the lever which is used for initiating suction of the suction recovery, which is movable along the movement of the cam 5020 which engages with the carriage. The movement of the lever is controlled by changing the driving power of the driving motor by use of the known transmission means such as a clutch.

The structure is arranged so that the capping, cleaning, and suction recovery are performed, respectively, in the corresponding positions as desired by the function of the lead screw 5005 when the carriage arrives in the region on the home position side. However, any structure may be applicable to the present embodiment if only the desired operation is made executable at the known timing. Each of the structures described above is regarded as an excellent invention individually or complexly, and also, to the present invention, each of them represents a preferable structural example, respectively.

In this respect, the apparatus described above is provided with driving signal supply means for driving ink discharge pressure generating elements.

In accordance with the present invention as described above, plural polysilicon layers are formed with an insulation layer between them, and the lower polysilicon layer is used for wiring and the upper polysilicon layer is used for heat generating resistive members. In this manner, it becomes possible to use polysilicon for the heat generating resistive members, and at the same time, to provide the vertically turn-up wiring structure for the heat generating resistive members arranged at pitches in high density.

Also, with the formation of plural polysilicon upper and lower layers with the insulation film between them, it becomes possible to connect the upper and lower two polysilicon layers with metallic wiring by arranging the structure to enable the upper polysilicon layer to be used for the heat generating resistive members, and the lower polysilicon layer for wiring.

Further, for the vertically turn-up wiring, a step is created on the substrate portion by use of polysilicon, hence making it possible to arrange the structure that may facilitate its assembling process for an easier assembling of the ceiling plate having on it grooves that become ink supply paths.

What is claimed is:

1. A substrate for use in an ink jet recording head, comprising:

a plurality of heat generating resistive members formed by polysilicon;

a wiring to be electrically connected with said heat generating resistive members; and a protection film formed on said heat generating resistive members and said wiring to protect them from ink, wherein a side of said wiring is connected with said heat generating resistive members being positioned immediately below said heat generating resistive members through an insulation film positioned at a lower layer of said heat generating resistive members, wherein said wiring includes a polysilicon wiring having a resistive characteristic lower than the polysilicon forming said heat generating resistive members, and a metallic wiring, wherein among the wiring, at least the polysilicon wiring is positioned immediately below said heat generating resistive members, wherein the polysilicon wiring is connected with the metallic wiring at a position different from said heat generating resistive members, and wherein the metallic wiring is Al or Cu individually or an alloy thereof.

2. A substrate assembly for use in an ink jet recording head according to claim 1, wherein each sheet resistance of said heat generating resistive members is 70 to 300 Ω/□, and a polysilicon sheet resistance of said wiring positioned immediately below them is 1 to 20 Ω/□.

3. A substrate assembly for use in an ink jet recording head according to claim 1, wherein a vertically turn-up portion of a plurality of vertically turn-up wiring structures using polysilicon for said heat generating resistive members, and the lower layer wiring with the insulation film between them, is arranged to form a step higher than the substrate portions positioned on both sides thereof.

4. A substrate assembly for use in an ink jet recording head according to claim 3, wherein each thickness of said heat generating resistive members and said wiring positioned immediately below them is 50 to 1,000 nm.

5. An ink jet recording head comprising:

a substrate assembly for use in an ink jet recording head according to any one of claim 1 to claim 4; and ink flow paths corresponding to said heat generating resistive members.

6. An ink jet recording apparatus comprising:

an ink jet recording head according to claim 5 for performing recording by discharging ink from a discharge port of said ink jet recording head in accordance with a recording signal.

7. A method for manufacturing a substrate for use in an ink jet recording head having a plurality of heat generating resistive members formed by polysilicon; a wiring to be electrically connected with said heat generating resistive members; and a protection film formed on said best generating resistive members and said wiring to protect them from ink, wherein a side of said wiring is connected with said heat generating resistive members being positioned immediately below said heat generating resistive members through an insulation film positioned at a lower layer of said heat generating resistive members, the method comprising the steps of:

forming a polysilicon wiring on the substrate;

forming the insulation film covering the polysilicon wiring and having a first through hole provided at a heat generating resistive member forming position and a second through hole provided at a position away from said heat generating resistive member forming position;

on the insulation film, forming a said heat generating resistive member, to be connected with the polysilicon wiring through the first through hole, formed by polysilicon having a resistive characteristic higher than the polysilicon forming the polysilicon wiring;

forming a first metallic wiring, to be connected with the polysilicon wiring through the second through hole on the insulation film subsequent to the formation of said heat generating resistive members;

forming a first protection film covering the heat generating resistive members and the first metallic wiring and having a third through hole exposing said heat generating resistive member;

forming a second metallic wiring, to be connected with said heat generating resistive members through the third through hole on the first protection film; and forming a second protection film covering the second metallic wiring, wherein said first and second metallic wiring is Al or Cu individually or an alloy thereof.

* * * * *

UNITED STATES PATENT AND TRADEMARK OFFICE

CERTIFICATE OF CORRECTION

PATENT NO. : 6,578,951 B2
DATED : June 17, 2003
INVENTOR(S) : Teruo Ozaki et al.

It is certified that error appears in the above-identified patent and that said Letters Patent is hereby corrected as shown below:

Column 1,
Line 41, “disclosed-in” should read -- disclosed in --.

Column 8,
Line 5, “best” should read -- heat --.

Signed and Sealed this

Eleventh Day of November, 2003

JAMES E. ROGAN
*Director of the United States Patent and Trademark Office*